US012528629B2

(12) United States Patent
Barrette et al.

(10) Patent No.: US 12,528,629 B2
(45) Date of Patent: Jan. 20, 2026

(54) ARTICLE CARRIER AND BLANK THEREFOR

(71) Applicant: WestRock Packaging Systems, LLC, Atlanta, GA (US)

(72) Inventors: Alex N. Barrette, Richmond, VA (US); Matthew E. Zacherle, Chesterfield, VA (US); Julien D. Merzeau, Chateauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 18/019,668

(22) PCT Filed: Aug. 3, 2021

(86) PCT No.: PCT/US2021/044279
§ 371 (c)(1),
(2) Date: Feb. 3, 2023

(87) PCT Pub. No.: WO2022/031655
PCT Pub. Date: Feb. 10, 2022

(65) Prior Publication Data

US 2023/0322458 A1 Oct. 12, 2023

Related U.S. Application Data

(60) Provisional application No. 63/060,603, filed on Aug. 3, 2020.

(51) Int. Cl.
*B65D 71/42* (2006.01)
*B65D 71/32* (2006.01)

(52) U.S. Cl.
CPC ..... *B65D 71/42* (2013.01); *B65D 71/32* (2013.01); *B65D 2571/00444* (2013.01); *B65D 2571/0066* (2013.01)

(58) Field of Classification Search
CPC ..... B65D 71/32; B65D 71/42; B65D 2571/0444; B65D 2571/066; B65D 71/50
(Continued)

(56) References Cited

U.S. PATENT DOCUMENTS 5,551,566 A * 9/1996 Sutherland ..... B65D 71/40 206/427
5,553,705 A * 9/1996 Bakx ..... B65D 71/42 206/158

(Continued)

FOREIGN PATENT DOCUMENTS

DE 29813672 U1 11/1998
DE 20319247 U1 * 5/2004 ..... B65D 71/42
WO 93/14993 A1 8/1993

OTHER PUBLICATIONS

International Search Report issued in PCT/US2021/044279, dated Nov. 10, 2021.

*Primary Examiner* — Bryon P Gehman
(74) *Attorney, Agent, or Firm* — Brian J. Goldberg; Rohini K. Garg; Tsugihiko Suzuki

(57) ABSTRACT

Aspects of the disclosure relate to a package, a carrier (90) for packaging one or more articles (B, B1, B2) and a blank (10; 110; 210; 310A, 310B) for forming the carrier. The package comprises an article carrier and one or more articles. The carrier comprises a main panel (14) having at least two article retention structures for receiving and securing the main panel to a respective article. Each of the at least two article retention structures comprises a center. The center C of the at least two article retention structures is spaced apart from the center of an adjacent one of the at least two article retention structures by a distance. The distance is greater than the maximum diameter of each of the at least two articles.

12 Claims, 8 Drawing Sheets

(58) Field of Classification Search
USPC ..... 206/145, 147–153
See application file for complete search history.

(56) References Cited

U.S. PATENT DOCUMENTS

| | | | | |
|---|---|---|---|---|
| 6,039,181 | A * | 3/2000 | Whiteside | B65D 71/42 206/427 |
| 6,293,392 | B1 * | 9/2001 | Galbierz | B65D 71/40 206/427 |
| 11,365,039 | B2 * | 6/2022 | Berga Ferres | B65D 71/42 |
| 11,628,994 | B2 * | 4/2023 | McCree | B31B 50/262 206/153 |
| 2018/0362234 | A1 * | 12/2018 | L'Heureux | B65D 71/44 |

* cited by examiner

ARTICLE CARRIER AND BLANK THEREFOR

TECHNICAL FIELD

The present invention relates to article carriers and to blanks for forming the same. More specifically, but not exclusively, the invention relates to a carrier of the top-gripping type having one or more apertures for receiving and retaining an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which apertures are provided in a panel of the carrier for receiving and engaging an article.

The present invention seeks to provide an improvement in the field of cartons, typically formed from paperboard or the like.

SUMMARY

A first aspect of the invention provides an article carrier for packaging at least two articles. Each article has a maximum diameter. The carrier comprises a main panel having at least two article retention structures for receiving and securing the main panel to a respective article. Each of the at least two article retention structures comprises a center. The center of the at least two article retention structures is spaced apart from the center of an adjacent one of the at least two article retention structures by a distance. The distance is greater than the maximum diameter of each of the at least two articles.

A second aspect of the invention provides package comprising an article carrier and at least two articles. Each article has a maximum diameter. The carrier comprises a main panel having at least two article retention structures for receiving and securing the main panel to a respective article. Each of the at least two article retention structures comprises a center. The center of the at least two article retention structures is spaced apart from the center of an adjacent one of the at least two article retention structures by a distance. The distance is greater than the maximum diameter of each of the at least two articles.

A third aspect of the invention provides a blank for forming at least two article carriers. The blank comprises at least two separable connected carrier blanks, each carrier blank comprising a plurality of article retention structures. Each of the plurality of article retention structures is configured to accommodate an article having a maximum diameter and comprises a center. The center of each article retention structure in a first carrier blank is spaced apart from the center of an adjacent article retention structure in said first carrier blank by a first distance. The center of each article retention structure in a second carrier blank is spaced apart from the center of an adjacent article retention structure in said second carrier blank by the first distance. The center of an article retention structure in the first carrier blank is spaced apart from the center of an adjacent article retention structure in the second carrier blank by a second distance. The first distance is greater than the maximum diameter of the article to be accommodated, and the second distance is equal to or greater than the first distance.

A fourth aspect of the invention provides carrier comprising at least two separable article carriers. Each article carrier comprises a plurality of article retention structures. Each of the plurality of article retention structures is configured to accommodate an article having a maximum diameter and comprises a center. The center of each article retention structure in a first article carrier is spaced apart from the center of an adjacent article retention structure in said first article carrier by a first distance. The center of each article retention structure in a second article carrier is spaced apart from the center of an adjacent article retention structure in said second article carrier by the first distance. The center of an article retention structure in the first article carrier is spaced apart from the center of an adjacent article retention structure in the second article carrier by a second distance. The first distance is greater than the maximum diameter of the article to be accommodated, and the second distance is equal to or greater than the first distance.

A fifth aspect of the invention provides package comprising at least two separable article carriers each comprising at least two articles. Each article carrier comprises a plurality of article retention structures. Each of the plurality of article retention structures is configured to accommodate an article having a maximum diameter and comprises a center. The center of each article retention structure in a first article carrier is spaced apart from the center of an adjacent article retention structure in said first article carrier by a first distance. The center of each article retention structure in a second article carrier is spaced apart from the center of an adjacent article retention structure in said second article carrier by the first distance. The center of an article retention structure in the first article carrier is spaced apart from the center of an adjacent article retention structure in the second article carrier by a second distance. The first distance is greater than the maximum diameter of the article to be accommodated, and the second distance is equal to or greater than the first distance.

Optionally, the difference between the second distance and the maximum diameter of the article is equal to or greater than twice the difference between the first distance and the maximum diameter of the article.

A sixth aspect of the invention provides an article carrier for packaging at least two articles. The article carrier has an engaging panel comprising a plurality of article retention structures. Each article retention structure comprises an aperture and an annular series of tabs disposed thereabout. The annular series of tabs is interrupted by a first recess and by a second recess. The first recess of a first one of the plurality of article retention structures is aligned with a first recess of a second one of the plurality of article retention structures disposed adjacent to said first one of the plurality of article retention structures. The second recess of the first one of the plurality of article retention structures is aligned with a second recess of a third one of the plurality of article retention structures disposed adjacent to the first one of the plurality of article retention structures.

Optionally, the first one of the plurality of article retention structures comprises a first center and the second one of the plurality of article retention structures comprises a second center, the first and second centers define a first notional line, the first notional line bisects the first recesses of the first and second ones of the plurality of article retention structures.

Optionally, the third one of the plurality of article retention structures comprises a third center, the first and third centers C define a second notional line, the second notional line bisects the second recesses of the first and third ones of the plurality of article retention structures.

Optionally, the second notional line is perpendicular to the first notional line.

A seventh aspect of the invention provides a blank for forming an article carrier. The blank comprises an engaging panel comprising a plurality of article retention structures. Each article retention structure comprises an aperture and an annular series of tabs disposed thereabout. The annular series of tabs is interrupted by a first recess and by a second recess. The first recess of a first one of the plurality of article retention structures is aligned with a first recess of a second one of the plurality of article retention structures disposed adjacent to said first one of the plurality of article retention structures. The second recess of the first one of the plurality of article retention structures is aligned with a second recess of a third one of the plurality of article retention structures disposed adjacent to the first one of the plurality of article retention structures.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale, and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
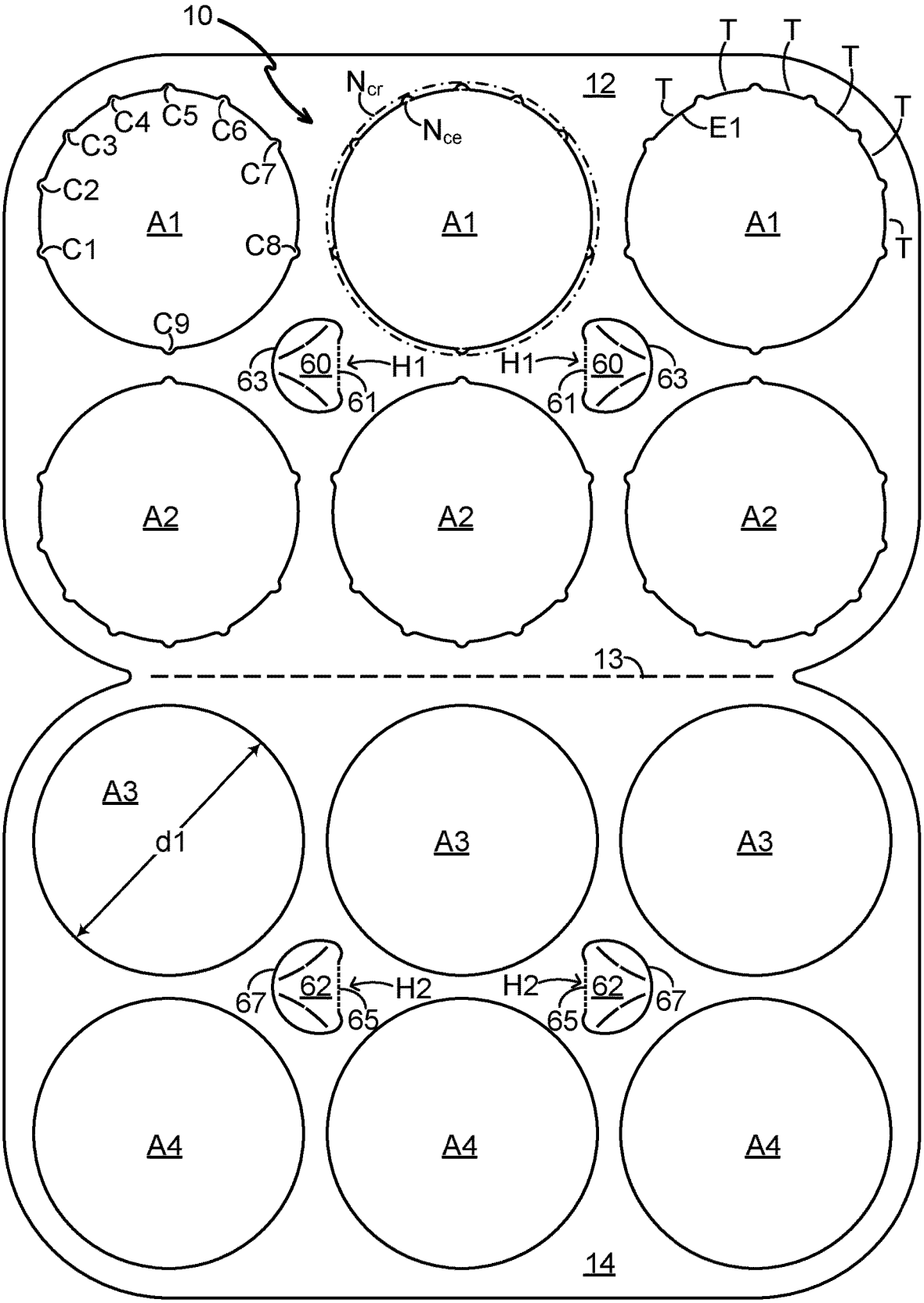
FIG. 1 is a plan view from above of a blank for forming a carrier according to a first embodiment.
Figure 2:
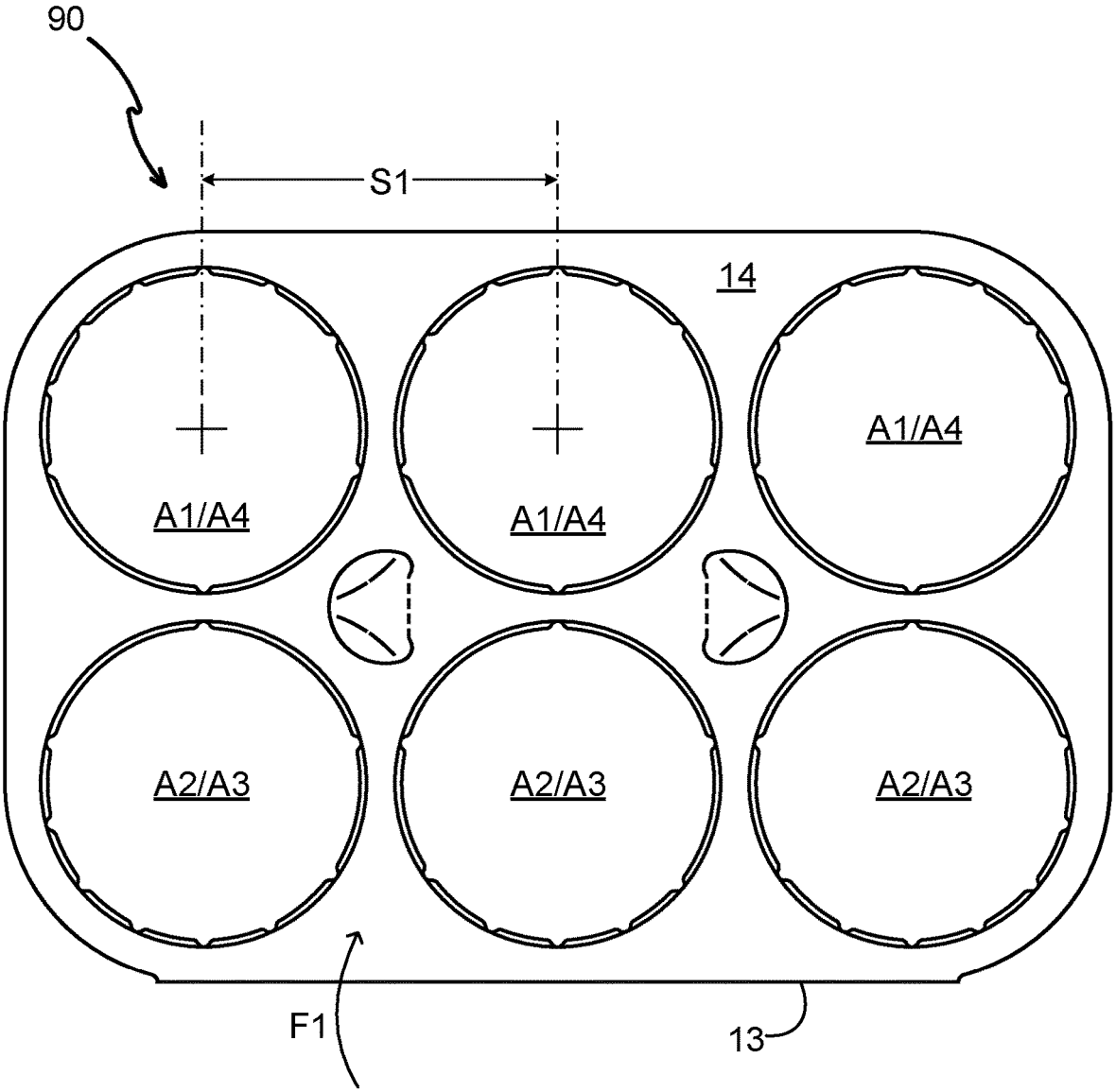
FIG. 2 is a plan view from below of a carrier formed from the blank of FIG. 1.
Figure 3:
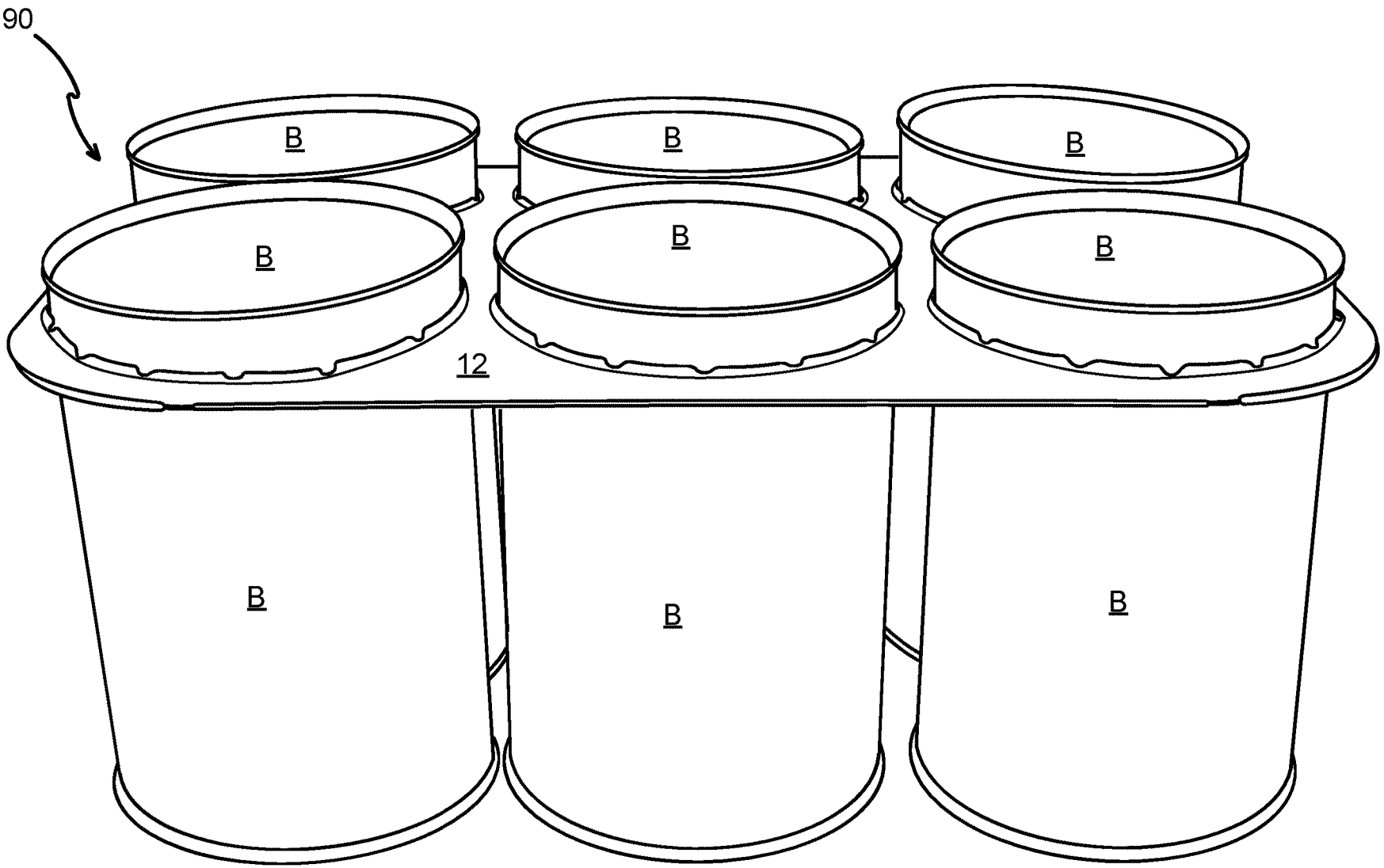
FIG. 3 is a perspective view from above of a package formed from the carrier of FIG. 2.

Referring to FIG. 1, there is shown a plan view of a blank 10 which is capable of forming a carton or carrier 90, as shown in FIG. 2, for containing and carrying a group of primary products such as, but not limited to, bottles or cans, hereinafter referred to as articles B, as shown in FIG. 3. The blank 10 forms a secondary package for packaging at least one primary product container or package.

Figure 4:
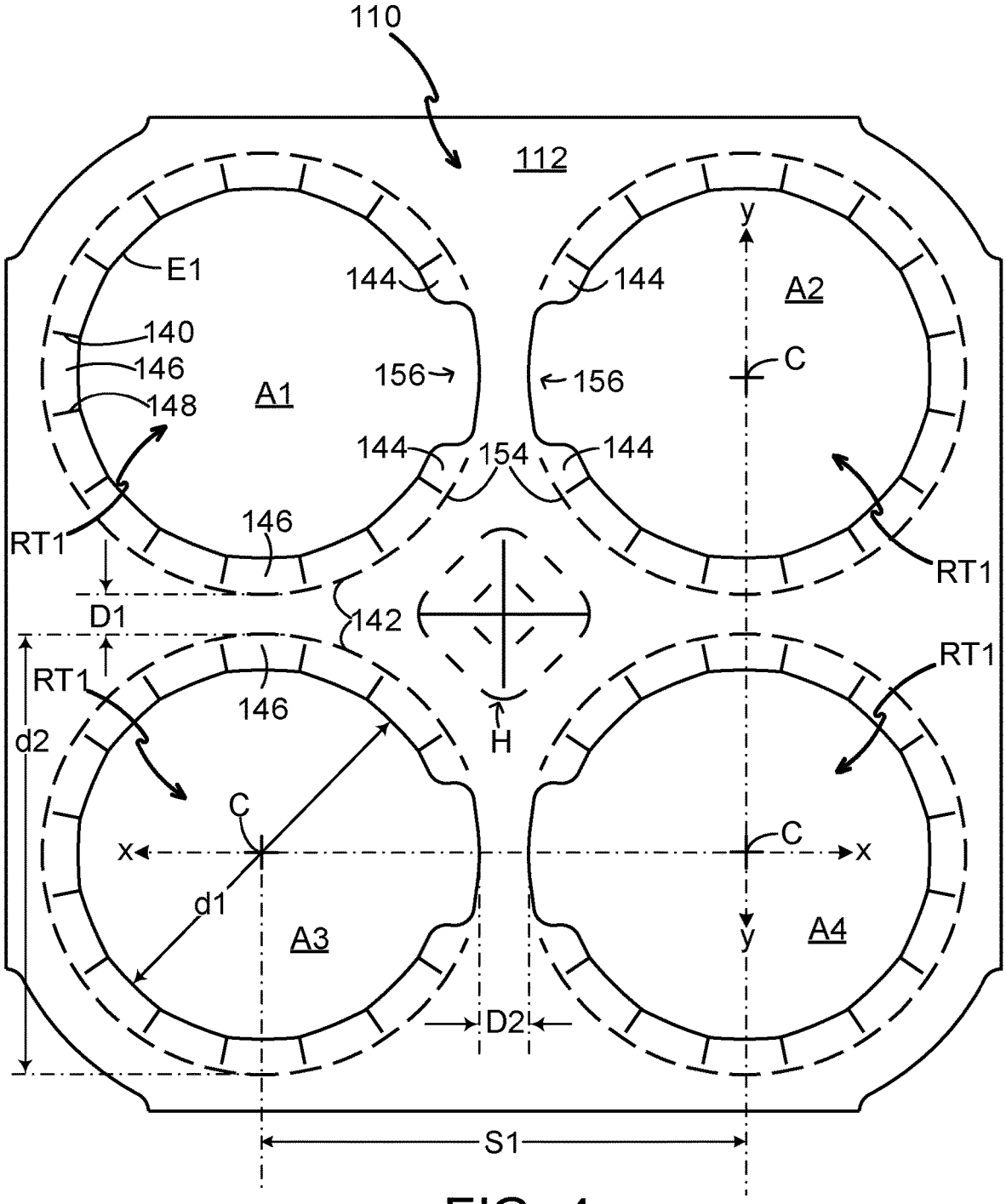
FIG. 4 is a plan view from above of a blank for forming a carrier according to a second embodiment.

Referring to FIG. 4, there is shown a plan view of a blank 110 which is capable of forming a carton or carrier (not shown), for containing and carrying a group of primary products such as, but not limited to, bottles or cans, hereinafter referred to as articles B, B1, B2. The blank 110 forms a secondary package for packaging at least one primary product container or package.

Figure 5:
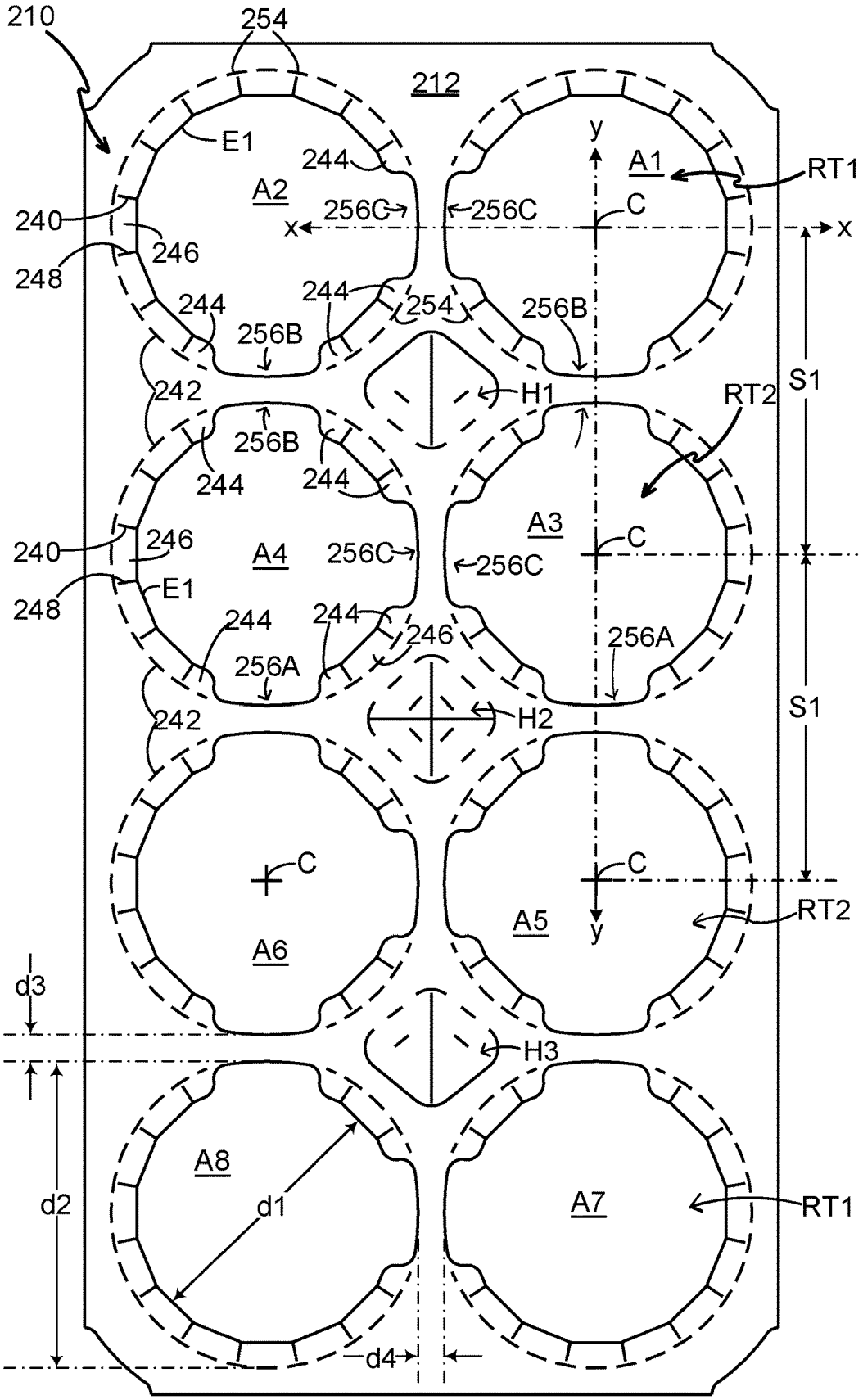
FIG. 5 is a plan view from above of a blank for forming a carrier according to a third embodiment.
Figure 6:
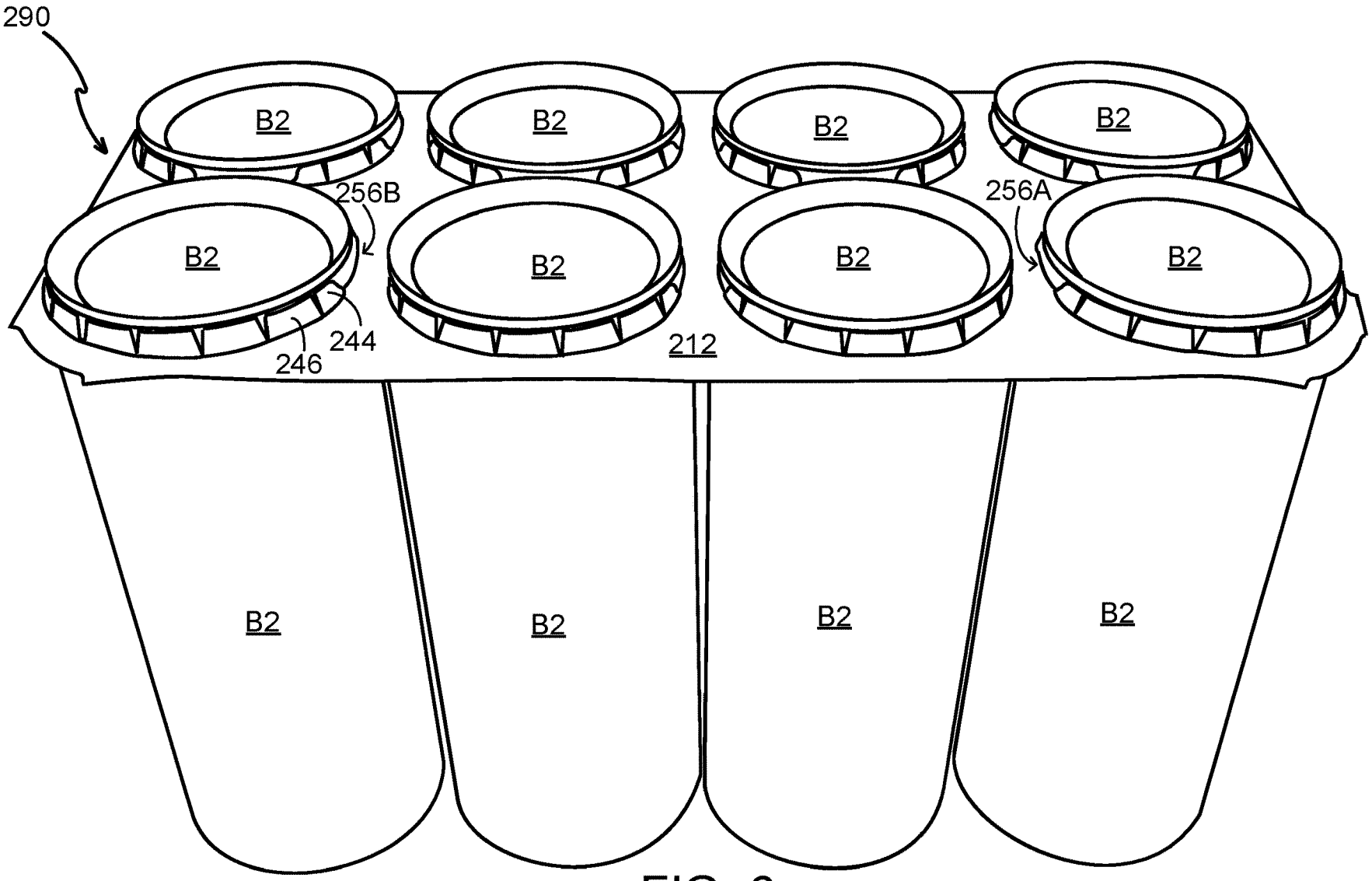
FIG. 6 is a perspective view from above of a package formed from the carrier of FIG. 5.

Referring to FIG. 5, there is shown a plan view of a blank 210 which is capable of forming a carton or carrier 290, as shown in FIG. 6, for containing and carrying a group of primary products such as, but not limited to, bottles or cans, hereinafter referred to as articles B2, as shown in FIG. 6. The blank 210 forms a secondary package for packaging at least one primary product container or package.

Figure 7:
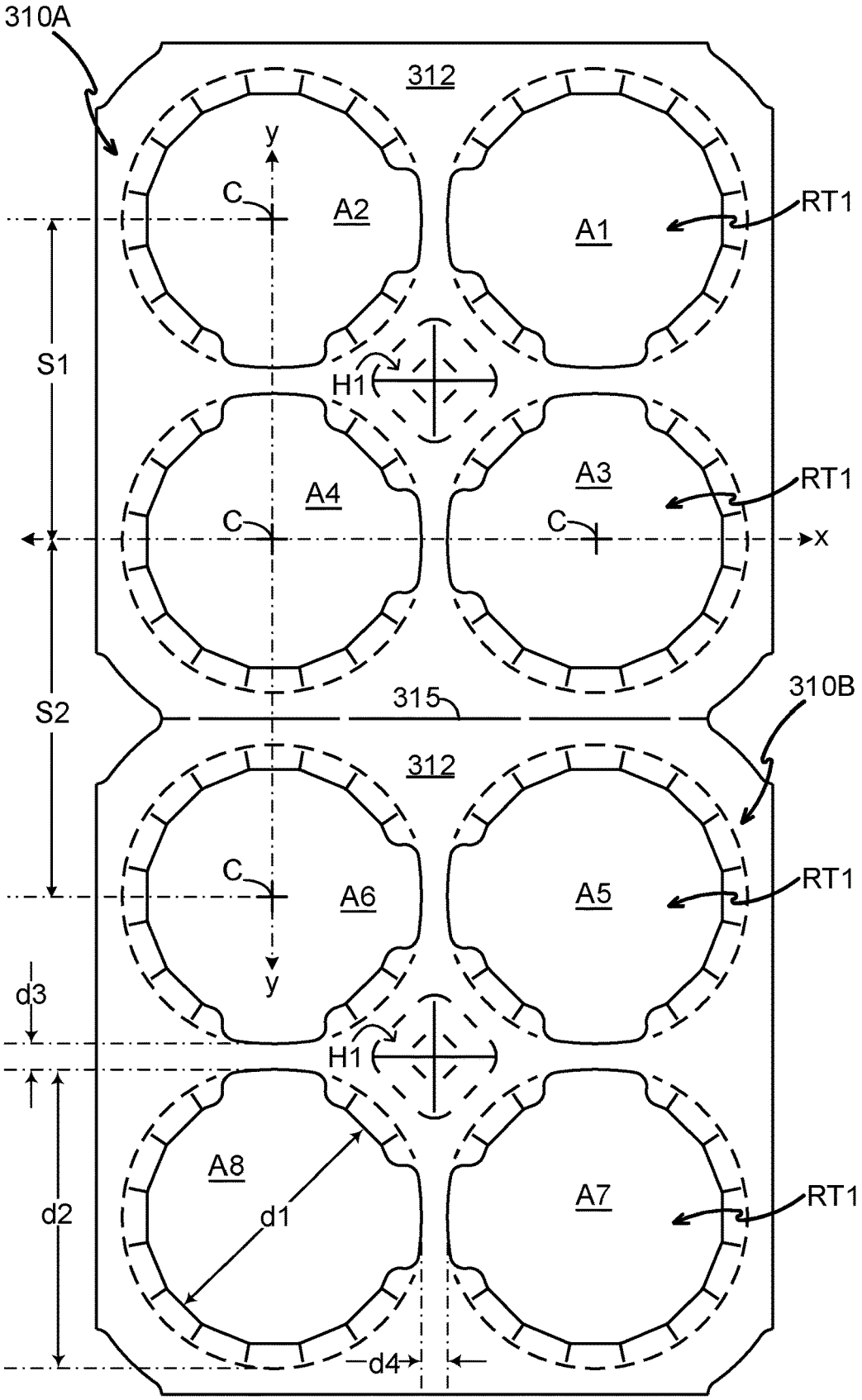
FIG. 7 is a plan view from above of a single blank device comprising a pair of connected blanks each for forming a carrier according to a fourth embodiment.

Referring to FIG. 7, there is shown a plan view of a single blank device comprising a pair of connected blanks 310A, 310B. Each of the blanks 310A, 310B is capable of forming a carton or carrier (not shown), for containing and carrying a group of primary products such as, but not limited to, bottles or cans, hereinafter referred to as articles B, B1, B2. The blanks 310A, 310B each forms a secondary package for packaging at least one primary product container or package.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminum cans), tins, pouches, packets, and the like.

The blanks 10; 110; 210; 310A, 310B are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures or cartons 90; 290 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

Figure 8B:
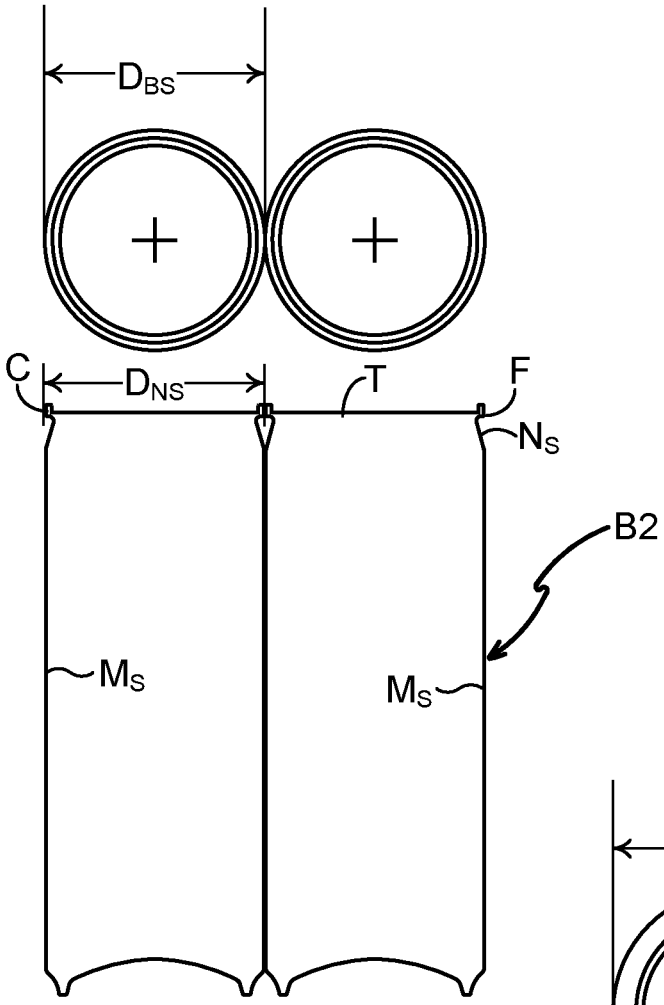
FIG. 8B is a plan view and side view of a pair of second articles for use with the blanks and carriers of present disclosure.
Figure 8C:
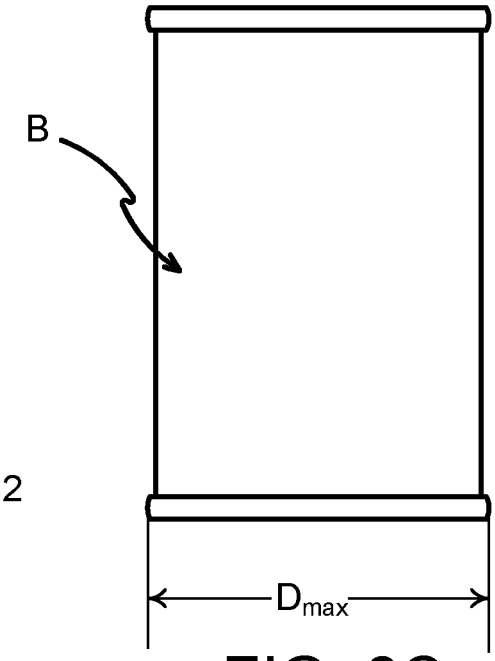
FIG. 8C is a side view of a third article for use with the blanks and carriers of present disclosure.
Figure 8A:
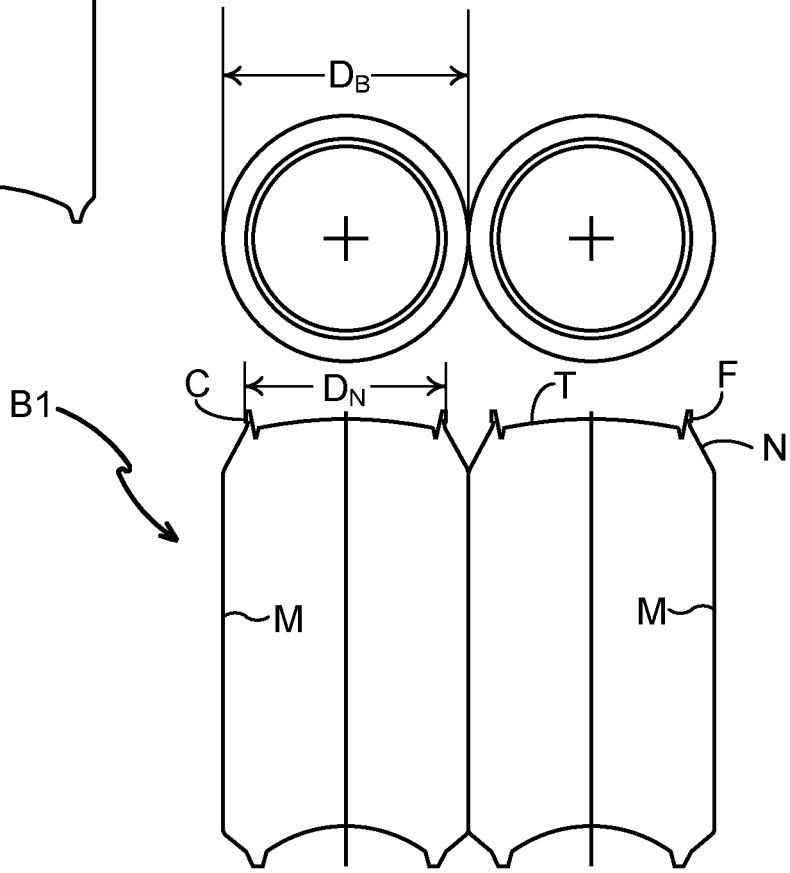
FIG. 8A is a plan view and side view of a pair of first articles for use with the blanks and carriers of present disclosure.

In the illustrated embodiments, the blanks 10; 110; 210; 310A, 310B are configured to form a carton or carrier 90 for packaging an exemplary arrangement of exemplary articles B, B1, B2 as shown in FIGS. 8A, 8B, and 8C.

In the embodiment illustrated in FIGS. 1 to 3, the arrangement is a 2×3 matrix or array; in the illustrated embodiment shown two rows of three articles B are provided, and the articles B are cans as shown in FIG. 8C. In the embodiment illustrated in FIG. 4, the blank 110 is arranged to accommodate articles B, B1, B2 in a 2×2 matrix or array. In the embodiment illustrated in FIGS. 5 and 6, the arrangement is a 2×4 matrix or array; in the illustrated embodiment shown two rows of four articles B2 are provided, and the articles B2 are beverage cans as shown in FIG. 8B. In the embodiment illustrated in FIG. 7, a single blank device comprising a pair of connected blanks 310A, 310B are provided, each blank being arranged to accommodate articles B, B1, B2 in a 2×2 matrix or array; the pair of blanks 310A, 310B may be applied simultaneously to a group of articles B, B1, B2 formed as a 2×4 matrix or array.

Alternatively, the blanks 10; 110; 210; 310A, 310B can be configured to form a carrier for packaging other types, number and size of articles and/or for packaging articles in a different arrangement or configuration.

The embodiments of FIG. 5 and FIG. 7 are configured to accommodate beverage cans of the sleek or slim design that may be 250 ml in capacity. The articles B2 are substantially of the same diameter over their entire height. An exemplary article B2 is illustrated in FIG. 8B, the article B2 has a maximum diameter or lateral dimension $D_{BS}$ (the diameter $D_{BS}$ may be about 53 mm). The article B2 comprises an upper portion or top closure T which has a diameter or lateral dimension $D_{NS}$ (the diameter $D_{NS}$ may be about 2 inches or 50.8 mm).

The embodiment of FIG. 4 is configured to accommodate beverage cans of the sleek or slim design that may be 330 ml in capacity. The articles B2 are substantially of the same diameter over their entire height. An exemplary article B2 is illustrated in FIG. 8B, the article B2 has a maximum diameter or lateral dimension $D_{BS}$ (the diameter $D_{BS}$ may be about 2.25 inches or about 58 mm). The article B2 comprises an upper portion or top closure T which has a diameter or lateral dimension $D_{NS}$ (the diameter $D_{NS}$ may be about 2.125 inches or 54.8 mm).

The neck $N_S$ may provide an outwardly projecting flange, that is to say, it may comprise an undercut for engaging with the carrier. A top closure T may be attached to the side wall of the article B2 to form a seam or "chime" C which provides the flange F. In some embodiments the variation in diameter between the top closure and the main body $M_S$ of the article B2 is less than 7 mm, may be less than 5 mm and optionally is less than 4 mm.

As used herein the terms "sleek" or "slim" refer to articles B2 which have little or no variation in their lateral dimension between the top closure T which engages with the carrier 290 and the main body $M_S$ of the article B2. The articles B2 are substantially parallel sided or of substantially uniform diameter.

The embodiment of FIGS. 1 to 3 is configured to accommodate 400 gram (411 ml capacity) food cans. An exemplary article B is illustrated in FIG. 8C, the article B has a maximum diameter or lateral dimension $D_B$ (the diameter $D_{MAX}$ may be about 2.96 inches or about 75 mm). The article B comprises upper and lower portions or end closures which define the maximum diameter or lateral dimension $D_{MAX}$.

In alternative embodiments the blanks 10; 110, 210; 310 may be configured to accommodate standard beverage cans for example 355 ml (12 fl. oz.) cans. An exemplary article B1 is illustrated in FIG. 8A, the article B1 has a maximum diameter or lateral dimension $D_B$ (the diameter $D_B$ may be about 2.6 inches or about 66 mm). The article B1 comprises an upper portion or top closure which has a diameter or lateral dimension $D_N$ (the diameter $D_N$ may be about 2.125 inches or 54.8 mm). In some embodiments the variation in diameter between the top closure and the main body M of the article B1 is greater than 7 mm, may be 10 mm or more and optionally may be at least 12 mm.

Referring to FIG. 1 there is shown a blank 10 comprising a pair of main panels 12, 14, including a first main panel 12 for forming an upper ply or layer of a top wall or an engaging panel of a carrier 90 (see FIG. 2) and a second main panel 14 for forming a lower ply or layer of the top wall or engaging panel. The first main panel 12 is hingedly connected to the second main panel 14 by a hinged connection in the form of a fold line 13.

The first main panel 12 includes at least one article retention structure. In the embodiment of FIGS. 1 and 2 the first main panel 12 comprises a plurality of article retention structures, specifically six article retention structures arranged in 2×3 matrix or array. Each of the article retention structures comprise an aperture A1, A2. A first row of article retention structures is provided each comprising a first aperture A1, a second row of article retention structures is provided each comprising a second aperture A2.

Each article retention structure comprises an article receiving opening defined in part by a respective one of the first and second apertures A1, A2.

Each of the article retention structures is substantially similar in construction and will therefore be described in detail with reference to article retention structures in the first row.

The apertures A1 comprises a perimeter which may approximate, or define, a first notional circle $N_{CE}$. The first notional circle $N_{CE}$ comprises a first radius.

Each article retention structure comprises a plurality of teeth T disposed about the circumference or perimeter of their respective article receiving opening.

The teeth T are formed in the main panel 12 about the apertures A1.

Each tooth T comprises an engaging or tooth edge E1. Each tooth edge E1 may be arcuate. The tooth edges E1 may be defined by an arc or portion of a circle. In some embodiments the tooth edges E1 are defined by a portion of a circle having a second radius which is greater than the first radius of the first notional circle $N_{CE}$ of the apertures A1.

The first main panel 12 comprises cutaways C1, C2, C3, C4, C5, C6, C7, C8, C9 in the form of recesses or notches. The cutaways C1, C2, C3, C4, C5, C6, C7, C8, C9 are substantially "U" shaped, the cutaways C1, C2, C3, C4, C5, C6, C7, C8, C9 each define a portion of a second notional circle $N_{CR}$. The second notional circle $N_{CR}$ comprises a third radius.

The cutaways C1, C2, C3, C4, C5, C6, C7, C8, C9 extend radially outward from the first notional circle $N_{CE}$ defined by the engaging edges E1 of the teeth T.

The teeth T are each defined, at least in part, by a pair of cutaways C1, C2, C3, C4, C5, C6, C7, C8, C9. The cutaways C1, C2, C3, C4, C5, C6, C7, C8, C9 form relief elements extending radially away from the center of the first notional circle $N_{CE}$.

The radius of curvature of the engaging edges E1 of the teeth T may be substantially greater than the radius of curvature of the cutaways C1, C2, C3, C4, C5, C6, C7, C8, C9.

Outermost portions of the cutaways C define the second notional circle $N_{CR}$, the second notional circle $N_{CR}$ is concentric with first notional circle $N_{CE}$ defined by the apertures A1, A2. The third radius of the second notional circle $N_{CR}$ is greater than the first radius of the first notional circle $N_{CE}$ defined by the apertures A1, A2. A gap, space or distance is defined radially therebetween, and may be considered to be the depth or radial dimension of the cutaways C1, C2, C3, C4, C5, C6, C7, C8, C9.

Optionally, the second notional circle $N_{CR}$ defined by the cutaways C1, C2, C3, C4, C5, C6, C7, C8, C9 is arranged to be substantially equal to, or slightly greater than a circle defined by a rim, chime or uppermost end of the article B, B1, B2 to be received therein. That is to say, the diameter $D_{MAX}$ of the rim, chime or uppermost end of the article B (see FIG. 8C) is substantially equal to, or slightly less than the twice the third radius.

The second main panel 14 comprises a plurality of third apertures A3, A4, the embodiment of FIG. 1 comprises six third apertures A3, A4 arranged in 2×3 matrix or array. Each of the third apertures A3, A4 is arranged to be disposed in registry with a respective one of the first or second apertures A1, A2 of the article retention structures in the first main panel 12. The radius of the third apertures A3, A4 may be substantially equal to, or greater than, the radius of the notional circle $N_{CR}$. The diameter d1 of the third apertures A3, A4 may be substantially equal to, or greater than, the diameter $D_{MAX}$ of the end closure of the articles B.

The second main panel 14 is configured to be disposed in face to face relationship with the first main panel 12.

The first main panel 12 may optionally comprise a first handle structure H1. The first handle structure H1 may comprise a pair of handle openings. Each handle opening may be defined by a tab 60 struck from the first main panel 12 each defined cutline or severance line 63 and hingedly connected to the first main panel 12 by a fold line 61. One of the pair of handle openings is located in a region centrally between a first pair of article retention structures and a second pair of adjacent article retention structures. The other one of the pair of handle openings is located in a region centrally between the second pair of article retention structures and a third pair of article retention structures disposed adjacently thereto. Each of the tabs 60 may comprise a pair of divergently arranged fold line extending substantially from the fold line 61.

The second main panel 14 may optionally comprise a second handle structure H2. The second handle structure H2 may comprise a pair of second handle openings. Each second handle opening is arranged to be disposed in registry with one of the pair of handle openings of the first handle structure H1. Each second handle opening may be defined by a tab 62 struck from the second main panel 14 substantially similar in construction to the tabs 60 of the first handle structure H1.

The blank 10 is formed into a carrier 90 by folding the second main panel 14 with respect to the first main panel 12 about fold line 13, as indicated by direction arrow F1 in FIG. 2.

The carrier 90 comprises article receiving openings A1/A4, A2/A3, the carrier 90 comprises a first row of article receiving openings A1/A4 and a second row of article receiving openings A2/A3. The centers of the article receiving openings A1/A4 in the first row are spaced apart by a distance S1, the centers of the article receiving openings A2/A3 in the second row are similarly arranged.

The distance S1 is greater than the maximum diameter $D_{MAX}$ of the articles B, in this way the article B are spaced apart from each other when loaded into the carrier 90, best shown in FIG. 3. The sidewall of each article B is spaced apart from the sidewall of its adjacent neighboring article B.

Referring now to FIG. 4, there is shown an additional embodiment of the present disclosure. In the second illustrated embodiment like numerals have, where possible, been used to denote like parts, albeit with the addition of the prefix "100" to indicate that these features belong to the second embodiment. The additional embodiment shares many common features with the first embodiment and therefore only the differences from the embodiment illustrated in FIGS. 1 to 3 will be described in detail.

FIG. 4 illustrates the second embodiment and shows a blank 110 comprising a main panel 112 for forming a top wall or an engaging panel of a carrier (not shown).

The main panel 112 may include at least one article retention structure RT1. In the embodiment of FIG. 4 the main panel 112 comprises a plurality of article retention structures RT1, specifically four article retention structures RT1 arranged in 2×2 matrix or array. The main panel 112 comprises two columns of article retention structures RT1, each column comprises two article retention structures RT1. The main panel 112 comprises two rows of article retention structures RT1, each row comprises two article retention structures RT1. Each of the article retention structures RT1 may comprise an aperture A1, A2, A3, A4.

Article retention structures RT1 in the same column are spaced apart from each other by a first spacing D1.

Article retention structures RT1 in the same row are spaced apart from each other by a second spacing D2.

In one example the spacing D1 may be 5 mm and the second spacing D2 may be 6.3 mm.

The article retention structures RT1 comprises an article receiving opening defined in part by an apertures A1, A2, A3, A4.

The article retention structures RT1 comprises a plurality of teeth 146, 144 disposed about the aperture A1, A2, A3, A4. The plurality of teeth 146, 144, or at least free edges thereof, may define or approximate a notional circle. The notional circle has a diameter d1.

The apertures A1, A2, A3, A4 have a width dimension d1. The article receiving openings have width or diameter d2. The diameter d2 of the article receiving openings is greater than the diameter d1 of notional circle or apertures A1, A2, A3, A4.

The plurality of teeth 146, 144 are hinged to the main panel 112 by a fold line. The fold line may be defined by a plurality of cut lines 142, 154. The plurality of cut lines 142, 154 may define or approximate a circle.

The article retention structures RT1 comprises a plurality of first or full teeth 146 disposed about the apertures A1, A2, A3, A4. Each of the plurality of first teeth 146 comprises an engaging edge E1 opposing a hinged edge. The engaging edges E1 are defined by a linear portion of a cut line defining the apertures A1, A2, A3, A4. Each engaging edge E1 defines a part of a hexadecagon. The illustrated embodiment comprises thirteen first teeth 146 together defining a substantial portion of a hexadecagon. Each first tooth 146 comprises a pair of side edges, the side edges are defined by cut lines 148, 140 extending radially outward from respective vertices of the hexadecagon. That is to say, from a respective vertex between a pair of adjacent linear portions of the cut line defining the apertures A1, A2, A3, A4. The cut lines 148, 140 are divergently arranged with respect to each other and define a first angle therebetween, the first angle may be about 22.5°.

The article retention structures RT1 comprises a plurality of first circumferential cut lines 154. Each of the plurality of first circumferential cut lines 154 is aligned with one of the radial cut lines 148, 140 such that said one of the radial cut lines 148, 140 or a notional extension thereof bisects a respective one of the plurality of first circumferential cut lines 154.

Each of the plurality of first circumferential cut lines 154 is spaced apart from said one of the radial cut lines 148, 140 bisecting it so as to define a connecting nick or bridge portion between a pair of adjacently disposed teeth 146, 144.

Each of the plurality of first circumferential cut lines 154 may be linear in shape.

The article retention structures RT1 comprises a plurality of second circumferential cut lines 142. Each of the plurality of second circumferential cut lines 142 is disposed between a pair of the plurality of first circumferential cut lines 154 and is spaced apart therefrom so as to define a pair of connecting nick or bridge portions between each tooth 146, 144 and the main panel 112. The pair of connecting nick or bridge portions provide a hinged or foldable connection between each tooth 146, 144 and the main panel 112.

Each of the plurality of second circumferential cut lines 142 may be linear in shape.

In alternative embodiments each of the plurality of first circumferential cut lines 154 may be arcuate or curved. The first circumferential cut lines 154 may comprise a radius of curvature which is equal to half the diameter d2 of the article receiving openings. The first circumferential cut lines 154 may comprise a radius of curvature which is greater than half the diameter d1 of the apertures A1, A2, A3, A4.

In alternative embodiments each of the plurality of second circumferential cut lines 142 may be arcuate or curved. The second circumferential cut lines 142 may comprise a radius of curvature which is equal to half the diameter d2 of the article receiving openings. The second circumferential cut lines 142 may comprise a radius of curvature which is greater than half the diameter d1 of the apertures A1, A2, A3, A4.

The first and second circumferential cut lines 142, 154 when linear may be considered to define portions of a circle of infinite radius.

In the illustrated embodiment, the radius of curvature of each of the plurality of second circumferential cut lines 142 is equal to the radius of curvature of each of the plurality of first circumferential cut lines 154 however in other embodiments it may be different.

Optionally, the plurality of teeth 146, 144 is interrupted by a recess or cutaway 156. The recess 156 lies upon a notional line x-x. Notional line x-x extends radially from the center C of the apertures A1, A2, A3, A4 and passes through the center of the recess 156. The notional line x-x may extend across the grain of the blank 110. The first notional line x-x is oriented perpendicularly with respect to the grain direction. The first notional line x-x extends longitudinally of the blank 110.

The recess 156 is dimensioned so as to occupy a first arc defined by a minor sector. The minor sector is defined in part by a first sector notional line extending radially from the center C of the notional circle and passing through a side edge of a first partial tooth 144 disposed adjacent a first side of the recess 156 and in part by a second sector notional line extending radially from the center C of the notional circle and passing through a side edge of a second partial tooth 144 disposed adjacent a second, opposing, side of the recess 156. The first and second sector notional lines define a second angle therebetween. The second angle may be in the range 35° to 50°, and may be around 45°. The first and second sector notional lines define a major sector about which the teeth 146, 144 are disposed or occupy.

The centers C of the article retention structures RT1 are spaced apart by a distance S1. The distance S1 is equal to the sum of the maximum diameter $D_{BS}$ of the article B2 and the spacing between adjacent articles B2, in one example $S1=D_{BS}+2.5$ mm.

The blank 110 may comprise an optional handle structure H. The handle structure H may comprise a handle opening disposed in a central region between a first pair of adjacent article retention structures RT1 and second pair of adjacent article retention structures RT1. The handle opening may be substantially diamond shaped, other shaped may be employed such as, but not limited to, a square. The handle opening may be defined by a plurality of tabs, in the illustrated embodiments four tabs each being substantially triangular in shape and being hingedly connected to the main panel 112 by a hinged connection in the form of a fold line. Each tab may comprise a further fold line arranged to truncate the triangular shaped tab.

Referring now to FIG. 5, there is shown an additional embodiment of the present disclosure. In the third illustrated embodiment like numerals have, where possible, been used to denote like parts, albeit with the addition of the prefix "200" to indicate that these features belong to the third embodiment. The additional embodiment shares many common features with the first and second embodiments and therefore only the differences from the embodiments illustrated in FIGS. 1 to 4 will be described in detail.

FIG. 5 illustrates the third embodiment and shows a blank 210 comprising a main panel 212 for forming a top wall or an engaging panel of a carrier 290, as shown in FIG. 6.

The main panel 212 may include at least one article retention structure RT1, RT2. In the embodiment of FIGS. 5 and 6, the main panel 212 comprises a plurality of article retention structures RT1, RT2 specifically eight article retention structures RT1, RT2 arranged in 4×2 matrix or array. The main panel 212 comprises two columns of article retention structures RT1, RT2, each column comprises four article retention structures RT1, RT2. The main panel 212 comprises four rows of article retention structures RT1, RT2, each row comprises two article retention structures RT1, RT2. Each of the article retention structures RT1, RT2 may comprise an aperture A1, A2, A3, A4, A5, A6, A7, A8.

The blank 210 comprises four first article retention structures RT1. The first article retention structures RT1 are located adjacent to ends of the main panel 212. The blank 210 comprises four second article retention structures RT2. The second article retention structures RT2 are located between a first pair of first article retention structures RT1 disposed proximate a first end of the main panel 212 and a second pair of first article retention structures RT1 disposed proximate a second end of the main panel 212. The second article retention structures RT2 are also referred to herein as intermediate article retention structures RT2. The first article retention structures RT1 are also referred to herein as end article retention structures RT1.

Article retention structures RT1, RT2 in the same column are spaced apart from each other by a spacing d3.

Article retention structures RT1, RT2 in the same row are spaced apart from each other by a spacing d4.

Each of the first article retention structures RT1 is substantially similar in construction.

Each first article retention structure RT1 comprises an article receiving opening defined in part by a respective aperture A1, A2, A7, A8.

Each first article retention structure RT1 comprises a plurality of teeth 246, 244 disposed about the respective aperture A1, A2, A7, A8. The plurality of teeth 246, 244, or at least free edges thereof, may define or approximate a notional circle. The notional circle has a diameter d1.

Each apertures A1, A2, A7, A8 have a width dimension d1. The article receiving openings has width or diameter d2. The diameter d2 of the article receiving openings is greater than the width dimension or diameter d1 of notional circle or the apertures A1, A2, A7, A8.

The plurality of teeth 246, 244 are hinged to the main panel 212 by a fold line. The fold line may be defined by a plurality of cut lines 242, 254. The plurality of cut lines 242, 254 may define or approximate a circle.

Each first article retention structure RT1 comprises a plurality of first or full teeth 246 disposed about the respective aperture A1, A2, A7, A8. Each of the plurality of first teeth 246 comprises an engaging edge E1 opposing a hinged edge. The engaging edges E1 are defined by a linear portion of a cut line defining the aperture A1, A2, A7, A8. Each engaging edge E1 defines a part of a hexadecagon. The illustrated embodiment comprises ten first teeth 246 together defining a substantial portion of a hexadecagon. Each tooth 246 comprises a pair of side edges, the side edges are defined by cut lines 248, 240 extending radially outward from respective vertices of the hexadecagon. That is to say, from a respective vertex between a pair of adjacent linear portions of the cut line defining the aperture A1, A2, A7, A8. The cut lines 248, 240 are divergently arranged with respect to each other and define a first angle therebetween, the first angle may be about 22.5°.

Each first article retention structure RT1 comprises a plurality of first circumferential cut lines 254. Each of the plurality of first circumferential cut lines 254 is aligned with one of the radial cut lines 248, 240 such that said one of the radial cut lines 248, 240 or a notional extension thereof bisects a respective one of the plurality of first circumferential cut lines 254.

Each of the plurality of first circumferential cut lines 254 is spaced apart from said one of the radial cut lines 248, 240 bisecting it so as to define a connecting nick or bridge portion between a pair of adjacently disposed teeth 246, 244.

Each of the plurality of first circumferential cut lines 254 may be linear in shape.

Each first article retention structure RT1 comprises a plurality of second circumferential cut lines 242. Each of the plurality of second circumferential cut lines 242 is disposed between a pair of the plurality of first circumferential cut lines 254 and is spaced apart therefrom so as to define a pair of connecting nick or bridge portions between each tooth 246, 244 and the main panel 212. The pair of connecting nick or bridge portions provide a hinged or foldable connection between each tooth 246, 244 and the main panel 212.

Each of the plurality of second circumferential cut lines 242 may be linear in shape.

In alternative embodiments, each of the plurality of first circumferential cut lines 254 may be arcuate or curved. The first circumferential cut lines 254 may comprise a radius of curvature which is equal to half the diameter d2 of the article receiving openings. The first circumferential cut lines 254 may comprise a radius of curvature which is greater than half the diameter d1 of the apertures A1, A2, A7, A8.

In alternative embodiments each of the plurality of second circumferential cut lines 242 may be arcuate or curved. The second circumferential cut lines 242 may comprise a radius of curvature which is equal to half the diameter d2 of the article receiving openings. The second circumferential cut lines 242 may comprise a radius of curvature which is greater than half the diameter d1 of the aperture A1, A2, A7, A8.

The first and second circumferential cut lines 242, 254 when linear may be considered to define portions of a circle of infinite radius.

In the illustrated embodiment, the radius of curvature of each of the plurality of second circumferential cut lines 242 is equal to the radius of curvature of each of the plurality of first circumferential cut lines 254 however in other embodiments it may be different.

Optionally, the plurality of teeth 246, 244 is interrupted by a first recess or cutaway 256B. The first recess 256B lies upon a first notional line y-y. First notional line y-y extends radially from the center C of the apertures A1, A2, A7, A8 and passes through the center of the first recess 256B. The first notional line y-y may extend across the grain of the blank 210. The first notional line y-y is oriented perpendicularly with respect to the grain direction. The first notional line y-y extends longitudinally of the blank 210.

Optionally, the plurality of teeth 246, 244 is interrupted by a second recess or cutaway 256C. The second recess 256C lies upon a second notional line x-x. Second notional line x-x extends radially from the center C of the apertures A1, A2, A7, A8 and passes through the center of the second recess 256C. The second notional line x-x may extend along the grain of the blank 210. The notional line x-x is oriented parallel with respect to the grain direction. The notional line x-x extends transversely, or laterally, of the blank 210.

The first recess 256B is dimensioned so as to occupy a first arc defined by a first minor sector. The first minor sector is defined in part by a first sector notional line extending radially from the center C of the notional circle and passing through a side edge of a first partial tooth 244 disposed adjacent a first side of the first recess 256B and in part by a second sector notional line extending radially from the center C of the notional circle and passing through a side edge of a second partial tooth 244 disposed adjacent a second, opposing, side of the first recess 256B. The first and second sector notional lines define a second angle therebetween. The second angle may be in the range 35° to 50°, and may be around 45°.

The second recess 256C is dimensioned so as to occupy a second arc defined by a second minor sector. The second minor sector is defined in part by a third sector notional line extending radially from the center C of the notional circle and passing through a side edge of a third partial tooth 244 disposed adjacent a first side of the second recess 256C and in part by a fourth sector notional line extending radially from the center C of the notional circle and passing through a side edge of a fourth partial tooth 244 disposed adjacent a second, opposing, side of the second recess 256C. The third and fourth sector notional lines define a third angle therebetween. The third angle may be in the range 35° to 50°, and may be around 45°.

The first and fourth sector notional lines define a major or first toothed sector, the first toothed sector defines a third arc; the third arc is occupied by teeth 246, 244. That is to say, teeth 246, 244 are disposed about the third arc, in a perimeter region of the aperture A1, A2, A7, A8.

The second and third sector notional lines define a third minor sector or second toothed sector, the second toothed sector defines a fourth arc; the fourth arc is occupied by teeth 246, 244. That is to say, teeth 246, 244 are disposed about the fourth arc, in a perimeter region of the aperture A1, A2, A7, A8.

Each of the second article retention structures RT2 is substantially similar in construction.

Each second article retention structure RT2 comprises an article receiving opening defined in part by a respective aperture A3, A4, A5, A6.

Each second article retention structure RT2 comprises a plurality of teeth 246, 244 disposed about the respective aperture A3, A4, A5, A6. The plurality of teeth 246, 244, or at least free edges thereof, may define or approximate a second notional circle.

The plurality of teeth 246, 244 are hinged to the main panel 212 by a fold line. The fold line may be defined by a plurality of cut lines 242, 254. The plurality of cut lines 242, 254 may define or approximate a circle.

Each aperture A3, A4, A5, A6 comprises a plurality of first or full teeth 246 disposed about the aperture A3, A4, A5, A6. Each of the plurality of first teeth 246 comprises an engaging edge E1 opposing a hinged edge. The engaging edges E1 are defined by a linear portion of a cut line defining the aperture A3, A4, A5, A6. Each engaging edge E1 defines a part or side of a hexadecagon. The illustrated embodiment comprises seven first teeth 246 together defining a substantial portion of a hexadecagon. Each tooth 246 comprises a pair of side edges, the side edges are defined by cut lines 248, 240 extending radially outward from respective vertices of the hexadecagon. That is to say, from a respective vertex between a pair of adjacent linear portions of the cut line defining the aperture A3, A4, A5, A6. The cut lines 248, 240 are divergently arranged with respect to each other and define an angle therebetween, the angle may be about 22.5°.

Each second article retention structure RT2 comprises a plurality of first circumferential cut lines 254. Each of the plurality of first circumferential cut lines 254 is aligned with one of the radial cut lines 248, 240 such that said one of the radial cut lines 248, 240, or a notional extension thereof, bisects a respective one of the plurality of first circumferential cut lines 254.

Each of the plurality of first circumferential cut lines 254 is spaced apart from said one of the radial cut lines 248, 240 bisecting it so as to define a connecting nick or bridge portion between a pair of adjacently disposed teeth 246, 244. The connecting nick or bridge portion is disposed proximate a base of the teeth 246.

Each of the plurality of first circumferential cut lines 254 may be linear in shape.

Each second article retention structure RT2 comprises a plurality of second circumferential cut lines 242. Each of the plurality of second circumferential cut lines 242 is disposed between a pair of the plurality of first circumferential cut lines 254 and is spaced apart therefrom so as to define a pair of connecting nick or bridge portions between each tooth 246, 244 and the main panel 212. The pair of connecting nick or bridge portions provide a hinged or foldable connection between each tooth 246, 244 and the main panel 212.

Each of the plurality of second circumferential cut lines 242 may be linear in shape.

The plurality of teeth 246, 244 is interrupted by a first recess or cutaway 256B, by a second recess or cutaway 256C and by a third recess or cutaway 256A. The first and third recesses 256B, 256A each lie upon the first notional line y-y. The first notional line y-y extends radially from the center C of the second aperture A3 and passes through the center of each of the first and third recesses 256B, 256A.

The first recess 256B is dimensioned so as to occupy a first arc defined by a first minor sector. The first minor sector is defined in part by a first sector notional line extending radially from the center C of the notional circle and passing through a side edge of a first partial tooth 244, disposed adjacent to a first side of the first recess 256B, and in part by a second sector notional line extending radially from the center of the notional circle and passing through a side edge of a second partial tooth 244, disposed adjacent to a second, opposing, side of the first recess 256B. The first and second sector notional lines define an angle therebetween. The angle may be in the range 35° to 50°, and may be around 45°.

The second recess 256C is dimensioned so as to occupy a second arc defined by a second minor sector. The second minor sector is defined in part by a third sector notional line extending radially from the center C of the notional circle and passing through a side edge of a third partial tooth 244, disposed adjacent to a first side of the second recess 256C, and in part by a fourth sector notional line extending radially from the center C of the notional circle and passing through a side edge of a fourth partial tooth 244, disposed adjacent to a second, opposing, side of the second recess 256C. The third and fourth sector notional lines define an angle therebetween. The third angle may be in the range 35° to 50°, and may be around 45°.

The third recess 256A is dimensioned so as to occupy a third arc defined by a third minor sector. The third minor sector is defined in part by a fifth sector notional line extending radially from the center C of the notional circle and passing through a side edge of a fifth partial tooth 244, disposed adjacent to a first side of the first recess 256A, and in part by a sixth sector notional line extending radially from the center C of the notional circle and passing through a side edge of a sixth partial tooth 244, disposed adjacent to a second, opposing, side of the first recess 256A. The fifth and sixth sector notional lines define an angle therebetween. The third angle may be in the range 35° to 50°, and may be around 45°.

The first and sixth sector notional lines define a major or first toothed sector, the first toothed sector defines a fourth arc; the fourth arc is occupied by teeth 246, 244. That is to say, teeth 246, 244 are disposed about the fourth arc, in a perimeter region of the aperture A3, A4, A5, A6.

The second and third sector notional lines define a fourth minor sector or second toothed sector, the second toothed sector defines a fifth arc; the fifth arc is occupied by teeth 246, 244.

That is to say, teeth 246, 244 are disposed about the fifth arc, in a perimeter region of the aperture A3, A4, A5, A6.

The fourth and fifth sector notional lines define a fifth minor sector or third toothed sector, the third toothed sector defines a sixth arc; the sixth arc is occupied by teeth 246, 244. That is to say, teeth 246, 244 are disposed about the sixth arc, in a perimeter region of the aperture A3, A4, A5, A6.

The first and third recesses 256B, 256A are diametrically opposed to each other.

The second recess is oriented or disposed substantially orthogonally to the first and third recesses 256B, 256A.

The centers of the first and third recesses 256B, 256A of each second article retention structure RT2 are collinear with the center of the first recess 256B of the adjacent first article retention structure RT1.

The first recess 256B of each second article retention structure RT2 is disposed proximate to the first recess 256B of the adjacent first article retention structure RT1 and is oriented in opposition thereto.

The second recess 256C of each second article retention structure RT2 is disposed proximate to the second recess 256C of the adjacently disposed second article retention structure RT2 in the same row, and is oriented in opposition thereto.

The second recess 256C of each first article retention structure RT1 is disposed proximate to the second recess 256C of the adjacently disposed first article retention structure RT1, and is oriented in opposition thereto.

The grain of the material forming the blank 210 may be arranged to be tangential to the center of the first and third recesses 256B, 256A of the second article retention structure RT2. The grain of the material forming the blank 210 may be arranged to be tangential to the center of the first recess 256B of the first article retention structure RT1. In this way, in order for a tear to propagate between, for example, the aperture A1 and the aperture A3, the tear must propagate across the grain of the blank 210. In this way, the blank 210 is arranged to provide maximum resistance to tear propagation between the apertures A1, A3.

Removal of the teeth 246, by providing recesses 256B, 256C, 256A at locations where two adjacent apertures A1, A2, A3, A4, A5, A6, A7, A8 are disposed in close proximity, for example when packaging articles B2 of the sleek or slim design, has been found to reduce the likelihood of tear propagation. This beneficial advantage may be a result of removal of the radial cut lines 248, 240 in regions of the blank 210 where the apertures A1, A2, A3, A4, A5, A6, A7, A8 are in closest proximity.

In one example the spacing d3, d4 between adjacent article retention structures RT1, RT2 may be around 4.5 mm. The diameter d2 of the article receiving openings may be around 2.098 inches or 53 mm.

The centers C of the article receiving openings are spaced apart by a distance S1, the distance S1 is equal to the sum of the maximum diameter $D_{BS}$ of the article B2 and the spacing between adjacent articles B2, in one example S1=$D_{BS}$+3 mm.

The main panel 212 may comprise an optional handle structure H1/H2/H3. The handle structure H1/H2/H3 may comprise at least one, two or more handle openings. The illustrated embodiment comprises three handle openings, each disposed in a central region between a first pair of adjacent article retention structures RT1, RT2 and second pair of adjacent article retention structures RT1, RT2.

A first handle opening H1 may be substantially diamond or kite shaped. The first handle opening may be defined by a plurality of tabs, in the illustrated embodiment two tabs each being substantially triangular in shape and being hingedly connected to the main panel 212 by a hinged connection in the form of a fold line. Each tab may comprise a further fold line arranged to truncate the triangular shaped tab. The tabs may be arranged to fold substantially towards the center of the main panel 212.

A second handle opening H2 may be substantially square in shape, other shaped may be employed such as, but not limited to, a diamond or kite shape. The second handle opening H2 may be defined by a plurality of tabs, in the illustrated embodiments four tabs each being substantially triangular in shape and being hingedly connected to the main panel 212 by a hinged connection in the form of a fold line. Each tab may comprise a further fold line arranged to truncate the triangular shaped tab.

A third handle opening H3 may be substantially diamond or kite shaped. The third handle opening H3 may be defined by a plurality of tabs, in the illustrated embodiment two tabs each being substantially triangular in shape and being hingedly connected to the main panel 212 by a hinged connection in the form of a fold line. Each tab may comprise a further fold line arranged to truncate the triangular shaped tab. The tabs may be arranged to fold substantially towards the center of the main panel 212.

Referring now to FIG. 7, there is shown an additional embodiment of the present disclosure. In the fourth illustrated embodiment like numerals have, where possible, been used to denote like parts, albeit with the addition of the prefix "300" to indicate that these features belong to the fourth embodiment. The additional embodiment shares many common features with the first, second and third embodiments and therefore only the differences from the embodiments illustrated in FIGS. 1 to 6 will be described in detail.

FIG. 7 illustrates the fourth embodiment and shows a pair of frangibly joined blanks 310A, 310B each comprising a main panel 312 for forming a top wall or an engaging panel of a carrier (not shown).

A first blank 310A is severably connected to a second blank 310B by a severable connection 315. Each of the first and second blanks 310A, 310B comprises at least one article retention structure RT1. In the embodiment of FIG. 7, each main panel 312 comprises a plurality of article retention structures RT1 specifically four article retention structures RT1 arranged in 2×2 matrix or array. The main panels 312 comprises two columns of article retention structures RT1, each column comprises two article retention structures RT1. The main panel 312 comprises two rows of article retention structures RT1, each row comprises two article retention structures RT1. Each of the article retention structures RT1 may comprise an aperture A1, A2, A3, A4, A5, A6, A7, A8.

The article retention structures RT1 are substantially the similar in construction to the first article retention structures RT1 of the embodiment of FIG. 5 and will not be described in further detail.

The centers C of the article receiving openings in the first blank 310A are spaced apart by a distance S1, the distance S1 is equal to the sum of the maximum diameter $D_{BS}$ of the article B2 and the spacing between adjacent articles B2, in one example S1=$D_{BS}$+3 mm.

The centers C of the article receiving openings in the second blank 310B are similarly spaced apart by a distance S1 (not illustrated), the distance S1 is equal to the sum of the maximum diameter $D_{BS}$ of the article B2 and the spacing between adjacent articles B2, in one example S1=$D_{BS}$+3 mm.

The center C of an article receiving opening in the first blank 310A is spaced apart from a center of an article receiving openings in the second blank 310B by a second distance S2. Second distance S2 is equal to or greater than first distance S1 (S2≥S1). The distance S2 is equal to the sum of the maximum diameter $D_{BS}$ of the article B2 and the spacing between an article B2 in the first carrier and an adjacent article B2 in the second carrier, in one example S2=$D_{BS}$+9 mm.

In one example the spacing d3, d4 between adjacent article retention structures RT1 may be around 4.5 mm. The diameter d2 of the article receiving openings may be around 53 mm.

Each of the first and second blanks 310A, 310B may comprise an optional handle structure H1. The handle structure H1 may comprise a handle opening disposed in a central region between a first pair of adjacent article retention structures RT1 and second pair of adjacent article retention structures RT1. The handle opening may be substantially diamond shaped, other shaped may be employed such as, but not limited to, a square. The handle opening may be defined by a plurality of tabs, in the illustrated embodiments four tabs each being substantially triangular in shape and being hingedly connected to the main panel 312 by a hinged connection in the form of a fold line. Each tab may comprise a further fold line arranged to truncate the triangular shaped tab.

The blanks 10; 110; 210; 310A, 310B include at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 24 point (pt.) SBS board (solid bleached sulfate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The blanks 10; 110 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

The present disclosure provides a carrier 90; 290 of the top engaging type having article retention structures RT1, RT2 for engaging articles B, B1, B2.

The carrier 90; 290 comprises a main panel 12; 112; 212; 312 having one, two, three, four or more article retention structures RT1, RT2 for receiving and securing the main panel 12; 112; 212; 312 B, to a respective article B, B1, B2.

The carrier 90; 290 comprises a plurality of article retention structures RT1, RT2 each configured to accommodate an article B, B1, B2 having a maximum diameter $D_{MAX}$, $D_{BS}$, $D_B$. Each of the plurality of article retention structures RT1, RT2 comprises a center C. The center C of each article retention structure RT1, RT2 is spaced apart from the center of an adjacent article retention structure RT1, RT2 by a distance S1, S2. The distance S1, S2 is greater than the maximum diameter $D_{MAX}$, $D_{BS}$, $D_B$ of the associated article B, B1, B2.

A blank 310A/310B comprising at least two separably connected carrier blanks 310A, 310B, each carrier blank 310A, 310B comprises a plurality of article retention structures RT1. Each of the plurality of article retention structures RT1 is configured to accommodate an article B, B1, B2 having a maximum diameter $D_{MAX}$, $D_{BS}$, $D_B$. Each of the plurality of article retention structures RT1 comprises a center C. The center C of each article retention structure RT1 in a first carrier blank 310A is spaced apart from the center of an adjacent article retention structure RT1 in said first carrier blank 310A by a first distance S1. The center C of each article retention structure RT1 in a second carrier blank 310B is spaced apart from the center of an adjacent article retention structure RT1 in said second carrier blank 310B by the first distance S1. The center C of an article retention structure RT1 in the first carrier blank 310B is spaced apart from the center of an adjacent article retention structure RT1 in said second carrier blank 310B by a second distance S2.

An article carrier comprising at least two separable article carriers, each article carrier comprises a plurality of article retention structures RT1. Each of the plurality of article retention structures RT1 is configured to accommodate an article B, B1, B2 having a maximum diameter $D_{MAX}$, $D_{BS}$, $D_B$. Each of the plurality of article retention structures RT1 comprises a center C. The center C of each article retention structure RT1 in a first carrier is spaced apart from the center of an adjacent article retention structure RT1 in said first carrier by a first distance S1. The center C of each article retention structure RT1 in a second carrier is spaced apart from the center of an adjacent article retention structure RT1 in said second carrier by the first distance S1. The center C of an article retention structure RT1 in the first carrier is spaced apart from the center of an adjacent article retention structure RT1 in said second carrier by a second distance S2.

The distance S1 is greater than the maximum diameter $D_{MAX}$, $D_{BS}$, $D_B$ of the associated article B, B1, B2. The second distance S2 is greater than or equal to the distance S1.

The difference between the second distance S2 and the maximum diameter $D_{MAX}$, $D_{BS}$, $D_B$ of the article B ($S2-D_{MAX}$) is equal to or greater than twice the difference between the first distance S1 and the maximum diameter $D_{MAX}$, $D_{BS}$, $D_B$ of the article B ($S1-D_{MAX}$);

$$S2-D_{MAX} \geq 2(S1-D_{MAX})$$

The carrier 90; 290 comprises a plurality of article retention structures RT1, RT2, each article retention structure RT1, RT2 comprising an aperture A1, A2, A3, A4, A5, A6, A7, A8 and an annular series of tabs or teeth T; 146, 144; 246, 244 disposed thereabout.

The annular series of tabs 246, 244 is interrupted by a first recess 256B and by a second recess 256C. The first recess 256B of a first one of the plurality of article retention structures RT1, RT2 is aligned with and disposed proximate to the first recess 256B of a second one of the plurality of article retention structures RT1, RT2 disposed adjacent to the first one of the plurality of article retention structures RT1, RT2. The second recess 256C of the first one of the plurality of article retention structures RT1, RT2 is aligned with and disposed proximate to the second recess 256C of a third one of the plurality of article retention structures RT1, RT2 disposed adjacent to the first one of the plurality of article retention structures RT1, RT2.

The first one of the plurality of article retention structures RT1, RT2 has a first center C and the second one of the plurality of article retention structures RT1, RT2 has a second center C; the first and second centers C defines a first notional line y-y. The first notional line y-y bisects the first recesses 256B of the first and second ones of the plurality of article retention structures RT1, RT2.

The third one of the plurality of article retention structures RT1, RT2 has a third center C. The first and third centers C defines a second notional line x-x. The second notional line x-x bisects the second recesses 256C of the first and third ones of the plurality of article retention structures RT1, RT2.

The second notional line x-x is perpendicular to the first notional line y-y.

It can be appreciated that various changes may be made within the scope of the present invention. For example, the size and shape of the panels and apertures may be adjusted to accommodate articles of differing size or shape. The inner and/or outer shoulder panels may be omitted entirely or may be included in any desired combination. The present invention is not limited to cartons of the top-engaging type, the invention may be employed with other carton styles such as, but not limited to, open top crates, lidded or closed top crates and fully enclosed cartons.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article carrier for packaging at least two articles, each of the at least two articles having a maximum diameter, the carrier comprising a main panel having at least two article retention structures for receiving and securing the main panel to a respective article, wherein the main panel comprises a pair of opposing side edges and a pair of opposing and edges, wherein each of the side edges has a length that is greater than a length of each of the end edges, wherein at least one of the side edges of the main panel is a free edge, and each of the at least two article retention structures comprises a center, the center of one of the at least two article retention structures being spaced apart from the center of an adjacent one of the at least two article retention structures by a distance, wherein the distance is greater than the maximum diameter of each of the at least two articles.

2. A blank for forming an article carrier for packaging at least two articles each of the at least two articles having a maximum diameter, the blank comprising a main panel having at least two article retention structures for receiving and securing the main panel to a respective article, wherein the main panel comprises a pair of opposing side edges and a pair of opposing end edges, wherein each of the side edges has a length that is greater than a length of each of the end edges, wherein at least one of the side edges of the main panel is a free edge, and each of the at least two article retention structures comprises a center, the center of one of the at least two article retention structures being spaced apart from the center of an adjacent one of the at least two article retention structures by a distance, wherein the distance is greater than the maximum diameter of each of the at least two articles.

3. A package comprising an article carrier and at least two articles, each of the at least two articles having a maximum diameter, the article carrier comprising a main panel having at least two article retention structures receiving and securing the main panel to a respective article, wherein at least one side edge of the main panel is a free edge, each of the at least two article retention structures comprises a center, the center of one of the at least two article retention structures being spaced apart from the center of an adjacent one of the at least two article retention structures by a distance, wherein the distance is greater than the maximum diameter of each of the at least two articles.

4. A blank device for forming at least two article carriers, the blank device comprising at least first and second blanks separably connected together, each blank comprising a plurality of article retention structures, wherein each of the plurality of article retention structures is configured to accommodate an article having a maximum diameter and comprises a center, the center of each article retention structure in the first blank being spaced apart from the center of an adjacent article retention structure in the first blank by a first distance, the center of each article retention structure in the second blank being spaced apart from the center of an adjacent article retention structure in the first blank by a second distance, and wherein the first distance is greater than the maximum diameter of the article to be accommodated, and the second distance is equal to or greater than the first distance.

5. A carrier comprising at least first and second separably connected article carriers, each article carrier comprising a plurality of article retention structures, wherein each of the plurality of article retention structures is configured to accommodate an article having a maximum diameter and comprises a center, the center of each article retention structure in the first article carrier being spaced apart from the center of an adjacent article retention structure in the first article carrier by a first distance, wherein the center of an article retention structure in the first article carrier is spaced apart from the center of an adjacent article retention structure in the second article carrier by a second distance, and wherein the first distance is greater than the maximum diameter of the article to be accommodated, and the second distance is equal to or greater than the first distance.

6. A package comprising at least first and second separably connected article carriers each comprising at least two articles, each article carrier comprising a plurality of article retention structures, wherein each of the plurality of article retention structures accommodating an article having a maximum diameter and comprises a center, the center of each article retention structure in the first article carrier being spaced apart from the center of an adjacent article retention structure in the first article carrier by a first distance, wherein the center of an article retention structure in the first article carrier is spaced apart from the center of an adjacent article retention structure in the second article carrier by a second distance, and wherein the first distance is greater than the maximum diameter of the article, and the second distance is equal to or greater than the first distance.

7. A package according to claim 6, wherein the difference between the second distance and the maximum diameter of the article is equal to or greater than twice the difference between the first distance and the maximum diameter of the article.

8. An article carrier for packaging at least three articles, the article carrier having an engaging panel comprising a plurality of article retention structures, each article retention structure comprising an aperture and an annular series of tabs disposed thereabout, wherein side edges of the annular series of tabs are defined by radial cutlines, the annular series of tabs being interrupted by at least two recesses including a first recess and a second recess, the first recess of a first one of the plurality of article retention structures being disposed proximate to the first recess of a second one of the plurality of article retention structures, the second one being disposed adjacent to the first one, the second recess of the first one being disposed proximate to the second recess of a third one of the plurality of article retention structures, the third one being disposed adjacent to the first one.

9. An article carrier according to claim 8, wherein the first one of the plurality of article retention structures comprises a first center and the second one of the plurality of article retention structures comprises a second center, the first and second centers define a first notional line, the first notional line bisects the first recesses of the first and second ones of the plurality of article retention structures.

10. An article carrier according to claim 9, wherein the third one of the plurality of article retention structures comprises a third center, the first and third centers define a second notional line, the second notional line bisects the second recesses of the first and third ones of the plurality of article retention structures.

11. An article carrier according to claim 10, wherein the second notional line is perpendicular to the first notional line.

12. A blank for forming an article carrier, the blank comprising an engaging panel comprising a plurality of article retention structures, each article retention structure comprising an aperture and an annular series of tabs disposed thereabout, wherein side edges of the annular series of tabs are defined by radial cutlines, the annular series of tabs being interrupted by at least two recesses including a first recess and a second recess, the first recess of a first one of the plurality of article retention structures being disposed proximate to the first recess of a second one of the plurality of article retention structures, the second one being disposed adjacent to the first one, the second recess of the first one being disposed proximate to the second recess of a third one of the plurality of article retention structures, the third one being disposed adjacent to the first one.

* * * * *